United States Patent [19]

Deutsch

[11] 4,150,600

[45] Apr. 24, 1979

[54] COMPUTER ORGAN WITH EXTENDED HARMONICS

[75] Inventor: Ralph Deutsch, Sherman Oaks, Calif.

[73] Assignee: Nippon Gakki Seizo Kabushiki Kaisha, Hamamatsu, Japan

[21] Appl. No.: 751,391

[22] Filed: May 10, 1977

[51] Int. Cl.[2] ..... G10H 3/00

[52] U.S. Cl. ..... 84/1.11; 84/1.17; 84/1.19; 84/1.13; 84/1.24

[58] Field of Search ..... 84/1.01, 1.03, 1.11, 84/1.17, 1.19, 1.24, 1.13, 1.26

[56] References Cited

U.S. PATENT DOCUMENTS

| | | | |
|---|---|---|---|
| 3,809,786 | 5/1974 | Deutsch | 84/1.01 |
| 3,809,788 | 5/1974 | Deutsch | 84/1.01 |
| 3,992,971 | 11/1976 | Chibana et al. | 84/1.11 |

*Primary Examiner*—Ulysses Weldon

*Attorney, Agent, or Firm*—Spensley, Horn, Jubas & Lubitz

[57] ABSTRACT

The inventive circuitry extends the harmonic content of musical tones produced by a computor organ of the type disclosed in U.S. Pat. No. 3,809,786. A memory stores values of an algebraic approximation of the summation of the amplitudes of a set of Fourier components of order higher than those separately evaluated by the computor organ itself. As each musical waveshape sample point amplitude is computed by the computor organ, the stored summation approximation value for the corresponding sample point is accessed from the memory. This accessed value is appropriately scaled, and is added to the sum of the lower order Fourier component contributions that are calculated by the computor organ. The resultant sample point amplitudes are converted to musical tones in real time. In an illustrative embodiment, musical tones having the spectral content of a sawtooth wave are produced.

12 Claims, 4 Drawing Figures

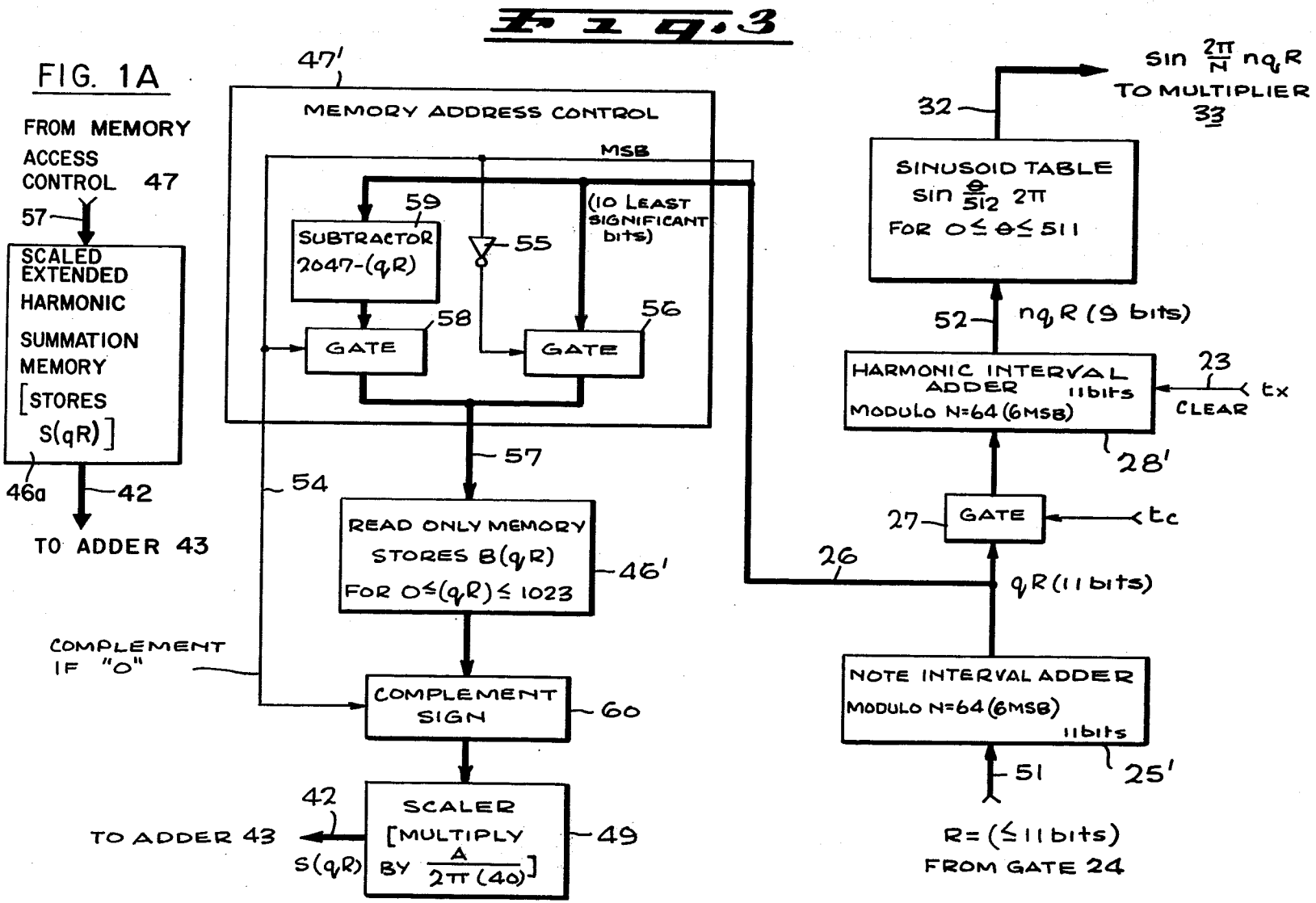
FIG. 3
SINUSOID TABLE
sin φ/512 2π
FOR 0≤φ≤511
32
sin 2π/N nqR
TO MULTIPLIER 33
nqR (9 bits)
52
HARMONIC INTERVAL ADDER
MODULO N=64 (6MSB)
11bits
28'
23
tx
CLEAR
GATE
27
tc
qR (11 bits)
26
NOTE INTERVAL ADDER
MODULO N=64 (6MSB)
11bits
25'
51
R=(≤11 bits)
FROM GATE 24
MEMORY ADDRESS CONTROL
47'
MSB
(10 LEAST SIGNIFICANT bits)
56
GATE
55
59
SUBTRACTOR
2047-(qR)
58
GATE
57
54
READ ONLY MEMORY
STORES B(qR)
FOR 0≤(qR)≤1023
46'
COMPLEMENT SIGN
60
SCALER
[MULTIPLY BY A/2π (40)]
49
42
S(qR)
TO ADDER 43
COMPLEMENT IF "0"
FIG. 1A
FROM MEMORY ACCESS CONTROL 47
57
SCALED EXTENDED HARMONIC SUMMATION MEMORY [STORES S(qR)]
46a
42
TO ADDER 43

COMPUTER ORGAN WITH EXTENDED HARMONICS

BACKGROUND OF THE INVENTION

1. Field of the Invention

The present invention relates to circuitry for extending the harmonic content of a computor organ of the type disclosed in U.S. Pat. No. 3,809,786, and particularly to the use of such extended harmonic circuitry in the generation of tones having the spectral shape of a sawtooth wave.

2. Description of the Prior Art

The computor organ disclosed in U.S. Pat. No. 3,809,786 enables the generation of a very wide range of musical waveshapes. This is accomplished by a Fourier synthesis technique in which the individual Fourier components of the waveshape are calculated separately and combined to obtain, in real time, the consecutive sample point amplitudes of the generated waveshape. Complete control of the spectral content thus is achieved, since the relative amplitude of each Fourier component is individually selectable.

For the generation of most musical waveshapes, the use of some limited number of Fourier components, typically 16 or 32, is sufficient for accurate synthesis of the desired tone. However, for the generation of an ideal sawtooth waveform, it is desirable to include a greater number of harmonics, say 48. This could be implemented by adding another parallel processing channel to the computor organ, to evaluate the 33rd through 48th order Fourier components. However, this solution would add to the cost and complexity of the musical instrument.

Thus, it is an object of the present invention to provide means for extending the harmonic content of a computor organ without utilizing an additional parallel processing channel. Other objects of the present invention include implementing the accurate synthesis of a sawtooth waveform in a computor organ, and the utilization of an appropriately programmed read-only memory to provide extended harmonic information during the generation of such a sawtooth waveform.

SUMMARY OF THE INVENTION

These and other objectives are accomplished by utilizing the theoretical properties of a sawtooth waveshape which permit the higher harmonic information to be provided from a preprogrammed read-only memory, instead of an additional parallel processing channel.

A sawtooth waveform can be represented by the following Fourier equation:

$$X(t) = A \sum_{n=o}^{\infty} \frac{1}{2\pi n} \sin \frac{2\pi nt}{T} \tag{1}$$

where X(t) is the waveshape amplitude at time t, where n is the harmonic number or order of the Fourier coefficient, where T specifies the time for one complete cycle of the waveshape, and where A is an amplitude scale factor.

From the foregoing equation (1) it is evident that all harmonics are present in a sawtooth waveform, and that A/n is a harmonic or Fourier coefficient which specifies the relative amplitude of the $n^{th}$ Fourier component. For components of sufficiently high order, the value 1/n becomes approximately equal to 1/(n+1) so that the corresponding Fourier coefficients become of approximately equal value. Thus, an error of about 20% is introduced by assuming that all of the harmonics from order n=33 to order n=48 are of equal amplitude. This can be seen since for n=33 the value 1/n=1/33=0.0303 and for n=48 the value 1/n=1/48=0.0208. If all of the Fourier components in this range $33 \leqq n \leqq 48$ have the amplitude A/n=A/40, the error at order n=33 is $$\text{Error} = 100 \times \frac{(1/33 - 1/40)}{1/33} = 17.5\% \tag{2}$$

and the error at order n=48 is $$\text{Error} = 100 \times \frac{(1/40 - 1/48)}{1/48} = 20\% \tag{3}$$

In actuality, the amplitudes of the harmonics of order n=33 and higher are down more than −30 db from the fundamental. At this low amplitude level, the human ear cannot detect small amplitude errors on the order of 20%. Thus, no degradation of the sensed sawtooth waveshape results from evalutating all of the Fourier components above order n=32 with the same amplitude. However, as described below, use of the same amplitude does result in considerable system simplification.

Assigning an amplitude of A/40 to all Fourier components of order $33 \leqq n \leqq 48$, and omitting all harmonics of order n>48 which are of very low amplitude and/or beyond the frequency limit of human hearing, equation (1) can be rewritten in the form:

$$X(t) = A \sum_{n=1}^{32} \frac{1}{2\pi n} \sin \frac{2\pi nt}{T} + \frac{A}{2\pi(40)} \sum_{n=33}^{48} \sin \frac{2\pi nt}{T} \tag{4}$$

The second summation can be written in algebraic form, since $$B = \sum_{\nu=x}^{y} \sin \nu\theta = \frac{[\sin \frac{\theta}{2}(x+y)][\sin \frac{\theta}{2}(y-x+1)]}{\sin \frac{\theta}{2}} \tag{5}$$

Using the relationship of equation (5), the second summation of equation (4) can be written as:

$$\frac{A}{2\pi(40)} \sum_{n=33}^{48} \sin \frac{2\pi nt}{T} = \tag{6}$$

$$\frac{A}{2\pi(40)} \frac{[\sin(\frac{\pi t}{T})81][\sin(\frac{\pi t}{T})16]}{\sin \frac{\pi t}{T}}$$

In the computor organ disclosed in U.S. Pat. No. 3,809,786 the waveshape amplitudes at successive sample points are evaluated at a fixed time interval $t_x$. The spacing between sample points is specified by the value R which is a frequency number associated with the fundamental frequency of each note of the instrument. At each time interval $t_x$ the value R is added to the contents of a "note interval" adder to obtain a value qR, where q=1,2,3, . . . is an integer incremented at each time interval $t_x$. The value qR thus specifies the particular sample point being evaluated, and is periodic, having a modulus N corresponding to a complete cycle of the generated waveshape. Rewriting equation (1) in terms of the computor organ system parameters qR and N, and using the relationship of equation (6), yields:

$$X(qR) = \sum_{n=1}^{32} \frac{A}{2\pi n} \sin \frac{2\pi}{N} nqR + \frac{A}{2\pi(40)} \frac{[\sin qR(\frac{81\pi}{N})][\sin qR(\frac{16\pi}{N})]}{\sin \frac{\pi qR}{N}} \quad (7)$$

For simplification of the following discussion, the terms in equation (7) are identified as follows:

$$F^{(n)} = \frac{A}{2\pi n} \sin \frac{2\pi}{N} nqR \quad (8)$$

and $$S(qR) = \frac{A}{2\pi(40)} B(qR) = \frac{A}{2\pi(40)} \frac{[\sin qR(\frac{81\pi}{N})][\sin qR(\frac{16\pi}{N})]}{\sin \frac{\pi qR}{N}} \quad (9)$$

so that equation (7) can be written in the form $$X(qR) = \sum_{n=1}^{32} F^{(n)} + S(qR) \quad (10)$$

In the computor organ system of this invention, the foregoing equation (10) is implemented by using a memory to provide during each time interval $t_x$, the value B(qR) which is scaled to provide the second term s(qR). This value S(qR) represents the sum of the amplitude contributions from all of the n=33 through n=48 order Fourier components of the sawtooth waveform. During the same time interval $t_x$, the contributions $F^{(n)}$ of each of the Fourier components of order n=1 through n=2 are separately evaluated and summed in accordance with the first term of equation (7) or (10). This is performed by the computor organ in a manner like that disclosed in U.S. Pat. No. 3,809,786.

Finally, the second term value S(qR) and the first term summation $$\sum_{n=1}^{32} F^{(n)}$$

are added together to obtain the waveshape sample point amplitude X(qR). Successive sample point amplitudes X(qR) are obtained in the same manner during consecutive time intervals $t_x$. As these sample point amplitudes are obtained, they are converted to analog form by a digital-to-analog converter to produce in real time a note having the spectral content of a sawtooth wave including extended harmonics.

BRIEF DESCRIPTION OF THE DRAWINGS

A detailed description of the invention will be made with reference to the accompanying drawings wherein like numerals designate like components in the several figures.

FIG. 1A shows an alternative embodiment of the inventive means of FIG. 1.

FIG. 3 is an electrical block diagram showing additional details of the system of FIG. 1.

DESCRIPTION OF THE PREFERRED EMBODIMENTS

The following detailed description is of the best presently contemplated modes of carrying out the invention. This description is not to be taken in a limiting sense, but is made merely for the purpose of illustrating the general principles of the invention since the scope of the invention is best defined by the appended claims.

Figure 1:
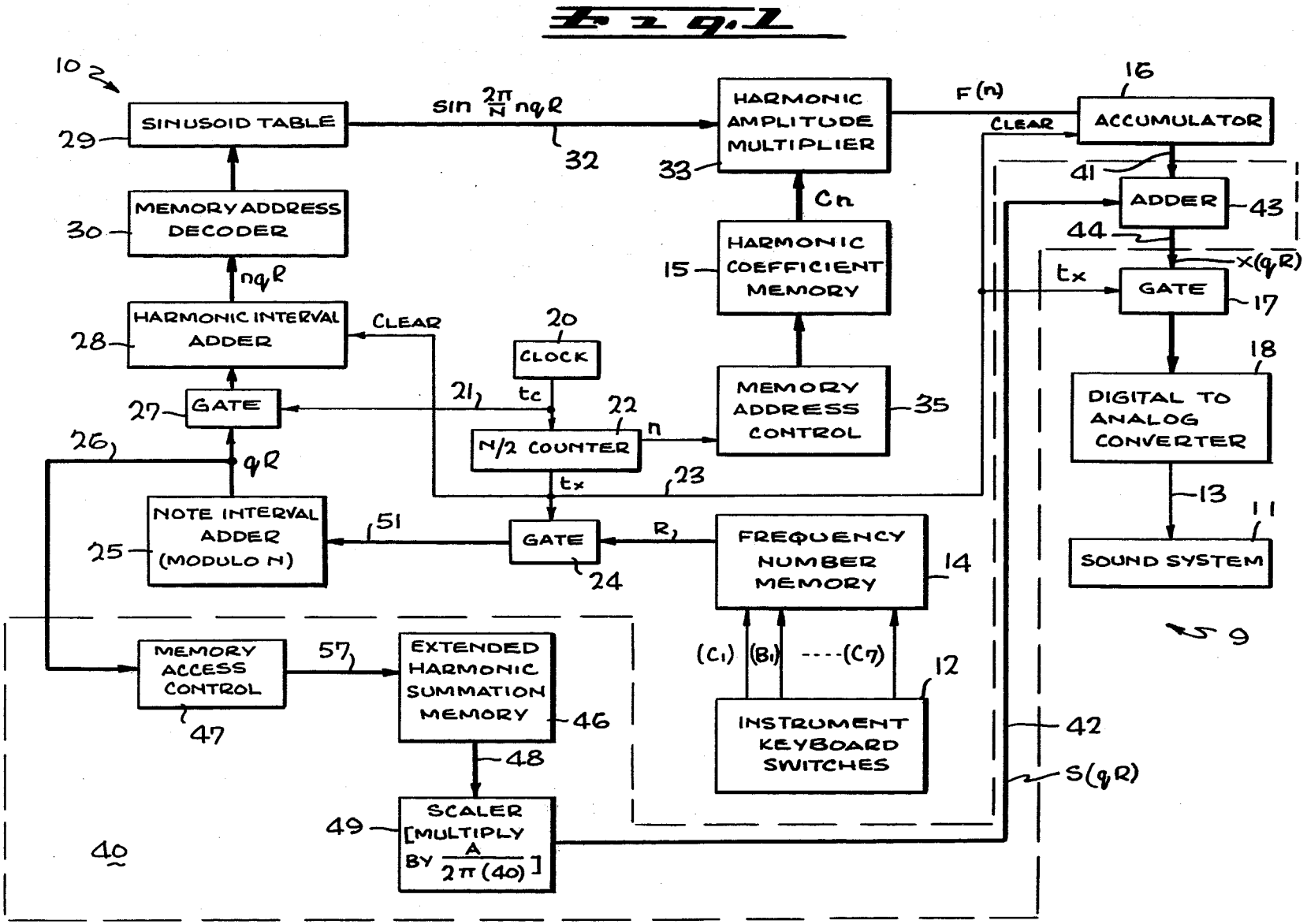
FIG. 1 is an electronic block diagram of a computor organ incorporating the inventive means for extending the harmonic content of the generated tones.

Musical tones having the spectral content of a sawtooth waveshape are generated by the system 9 of FIG. 1 which implements equation (7) above. This system comprises a computor organ 10 of the type described in U.S. Pat. No. 3,809,786 together with circuitry 40 which, in accordance with the present invention, extends the harmonic content of the generated tones. The computor organ 10 implements the first term of equation (7) so as to provide on a line 41 the summation $$\sum_{n=1}^{32} F^{(n)}.$$

The circuitry 40 implements the second term of equation (7) and provides the value S(qR) on a line 42. These two terms are added in an adder 43 to provide on a line 44 the waveshape amplitude X(qR) for the sample point currently being evaluated. This value is supplied via a gate 17 to a digital-to-analog converter 18 that drives a sound system 11 via a line 13. Successive sample point amplitudes are generated each time interval $t_x$, so that there is produced from the sound system 11 a musical tone having the spectral content of a sawtooth wave.

The computor organ 10 is described in detail in the above-referenced U.S. Pat. No. 3,809,786. The computor organ components designated by the numerals 11 through 35 in FIG. 1 correspond to the like-numbered components shown in FIG. 1 of that U.S. patent. Operation of the computor organ 10 is briefly summarized below.

In the computor organ 10 (FIG. 1) the individual Fourier components $F^{(n)}$ are separately evaluated during successive calculation time intervals $t_{cp1}$ through $t_{cp32}$ established by a clock 20 and a counter 22. The Fourier components are summed in an accumulator 16. Thus at the end of each computation time interval $t_x$, the contents of the accumulator 16 represents the summation $$\sum_{n=1}^{32} F^{(n)}$$

for the current sample point qR.

A computation interval $t_x$ timing pulse is provided on a line 23 by the counter 22 shortly after occurrence of the last calculation interval pulse $t_{cp32}$. Occurrence of the $t_x$ pulse causes the contents of the accumulator 16 to be added to the value S(qR) in the adder 43, so that the resultant sample point amplitude X(qR) will be supplied via a gate 17 to a digital-to-analog converter 18. The accumulator 16 then is cleared in preparation for summing of the Fourier components associated with the next sample point, computation of which components begins immediately.

The digital-to-analog converter 18 supplies to the sound system 11 a voltage corresponding to the waveshape amplitude just computed. Since these computations are carried out in real time, the analog voltage supplied from the converter 18 on a line 13 comprises a musical waveshape having a fundamental frequency established by a frequency number R supplied from a memory 14 in response to selection of a note on the keyboard 12.

At the beginning of each computation interval $t_x$, the frequency number R is supplied via a gate 24 and added to the previous contents of a note interval adder 25. Thus the contents of the adder 25, supplied via a line 26, represents the value (qR) designating the waveshape sample point currently being evaluated. Preferably the note interval adder 25 is of modulo N=2W=64 where W=32 is the highest order Fourier component included in the summation $$\sum_{n=1}^{32} F^{(n)}.$$

Each calculation clock pulse $t_c$ is supplied to a gate 27. This gate 27 provides the value qR to a harmonic interval adder 28 which is cleared at the end of each amplitude computation interval $t_x$. The adder 28 also is of modulo N=2W=64. The contents of the harmonic interval adder 28 is incremented by the value (qR) at each calculation interval $t_{cp1}$ through $t_{cp32}$, so that the contents of the adder 28 represents the quantity (nqR).

An address decoder 30 accesses from a sinusoid table 29 the value sin $2\pi/N$ nqR corresponding to the argument nqR received from the adder 28. The sinusoid table 29 may comprise a read only memory storing values of sin $2\pi/N\phi$ for $0 \leqq \phi \leqq N$ at intervals of D, where D is called the resolution constant of the memory. With this arrangement, the value sin $2\pi/N$ qR will be supplied on a line 32 during the first calculation interval $t_{cp1}$. During the next interval $t_{cp2}$, the value sin $2\pi/N$ 2qR will be present on the line 32. Thus in general, the value sin $2\pi/N$ nqR will be provided from the sinusoid table 29 for the particular $n^{th}$ order component specified by the timing interval output from the counter 22.

A set of harmonic coefficients $C_n$ is stored in a harmonic coefficient memory 15. As each sinusoid value is supplied on the line 32, the harmonic coefficient $C_n$ for the corresponding $n^{th}$ order component is accessed from the memory 15 by a memory address control circuit 35 which receives a signal indicative of the order n from the counter 22. The sin value from the line 32 is multiplied by the accessed coefficient $C_n$ in a harmonic amplitude multiplier 33. The product, corresponding to the value of the Fourier component $F^{(n)}$ presently being evaluated, is supplied via a line 34 to the accumulator 16.

Referring still to FIG. 1, the circuitry 40 used to implement the second term of equation (7) includes a read-only memory 46 which contains a set of values B(qR) for a complete cycle of the sample point variable (qR). At each computation time interval $t_x$, when a new value of (qR) is present on the line 26, a memory access control 47 causes the corresponding value B(qR) to be read out from this "extended harmonic summation" memory 46 and supplied on a line 48 to a scaler 49. In the scaler 49, the value B(qR) is multiplied by the constant $A/2\pi(40)$ to obtain the value S(qR) for the current sample point (qR). This value s(qR) is provided on the line 42 to the adder 43 where it is added to the contents of the accumulator 16, representing the summation of the first (n=1) through thirty-second (n=32) Fourier components evaluated by the computor organ 10. The output of the adder 43, representing the sample point amplitude X(qR) according to equation (7), is supplied via the line 44 and the gate 17 as described above.

Details of a preferred embodiment of the present invention are shown in FIG. 3. In this embodiment, the frequency number R advantageously is in digital form and has at least eleven binary bits. The selected value R is supplied via the gate 24 and a line 51 to the note interval adder 25'. The "line 51" in practice is a parallel channel capable of handling in parallel all eleven bits representing the frequency number R.

The note interval adder 25' is of modulo N=64. To this end, the adder 25' itself is eleven bits long, with the six most significant bits being used to reset the adder when they exeeed the value "111111" (i.e., binary 63). That is, an overflow of the six most significant bits will reset the adder 25' so that it continues the addition with these six bits reset to zero. This implements the modulo N=64 function.

The six most significant binary bits contained in the adder 25' represent the integer portion of the value (qR) and the remaining five bits of lesser significance represent the fractional part.

The eleven bit contents of the adder 25', representing the value (qR) is supplied via the line 26 both to the gate 27 and to the memory access control 47'. From the gate 27, the value (qR) is supplied to the harmonic interval adder 28' which advantageously is configured like the note interval adder 25'. The adder 28' is eleven bits long, with the six most significant bits being used to establish the modulo (n=64). The nine most significant bits contained in the harmonic interval adder 28' represent the value (nqR), and are supplied on a line 52.

Advantageously, the sinusoid table 29' contains one full cycle of values at 512 consecutive sample points. That is, the sinusoid table 29' stores the values sin $\theta 2\pi/512$ for $0 \leqq \theta \leqq 511$. These sin values are accessed in accordance with the nine-bit value (nqR) supplied on the line 52.

During generation of one cycle of the synthesized tone, as the contribution of the fundamental (n=1) component is evaluated, the six most significant bits in the note interval adder 25' will range from decimal 0 through decimal 64. Correspondingly, the entire 9 bits (for nqR=1qR) on the line 52 will range from approximately zero to decimal 511, so that the table 29' will be accessed through a complete sinusoid cycle. In this embodiment, the sinusoidal table 29' may comprise an integrated circuit read-only memory having 512 storage locations. The memory address decoder 30 may comprise the access circuitry, contained within the integrated circuit, which uses the signal (nqR) from the line 52 to specify the storage location from which the requisite sin value is read.

Figure 2:
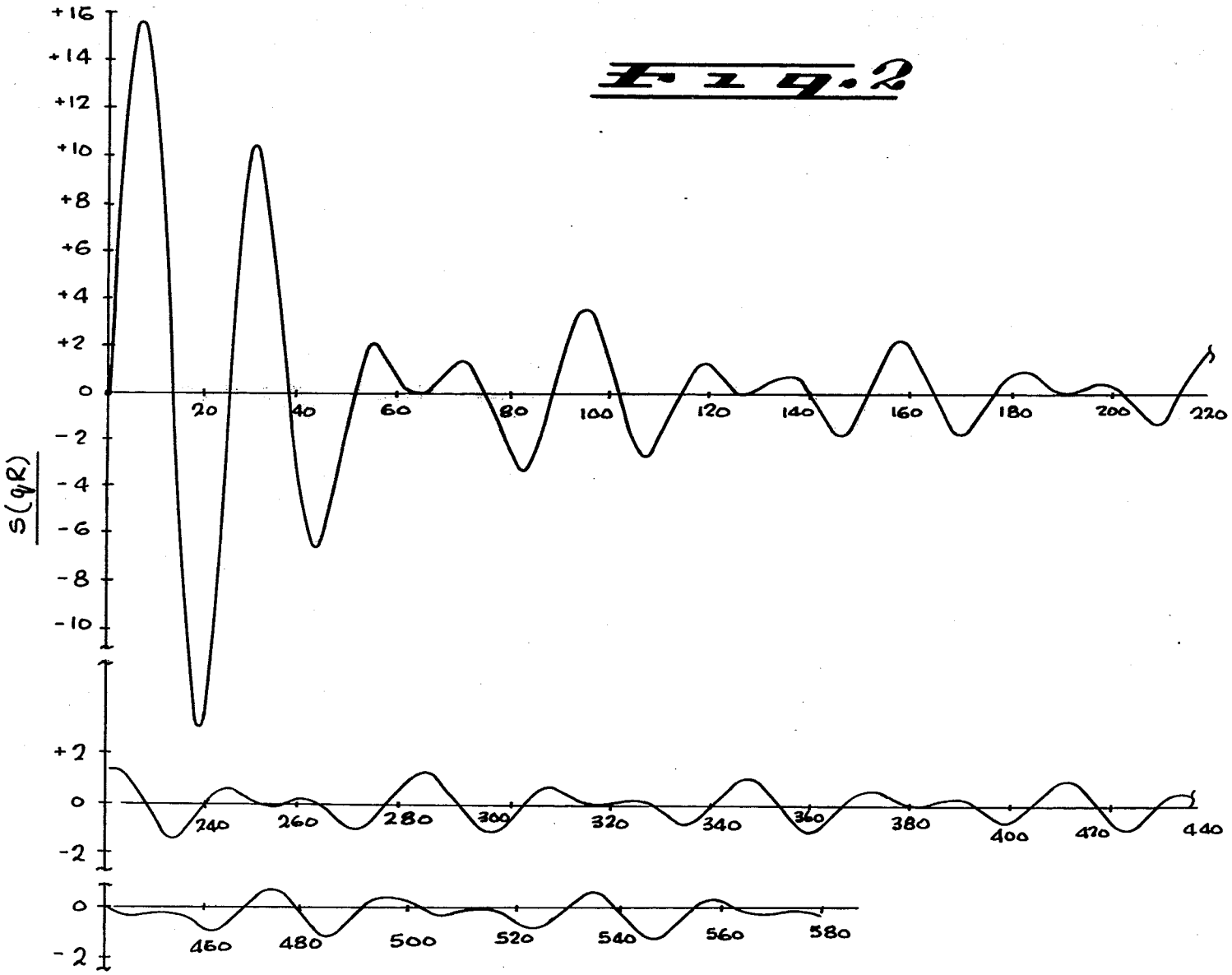
FIG. 2 is a graph indicating the contents of the extended harmonic summation memory employed in the system of FIG. 1.

Typical values of B(qR) from equation (9) are shown in FIG. 2 for a portion of the repetitive cycle of that equation. From FIG. 2 it can be seen that within a single repetitive cycle, the value of B(qR) alternates between positive and negative values with different amplitude.

During generation of a single cycle of the synthesized musical waveshape, as the sample point value (qR) ranges from zero to the modulo value N, the value of B(qR) for each corresponding sample point (qR) is accessed from the memory 46 (FIG. 1). In view of the variation of the values B(qR) over a complete repetitive cycle, as partially illustrated in FIG. 2, it is preferred that the memory 46 store sampled amplitudes of B(qR) at the large number of sample points. Quite adequate resolution is achieved by having one repetitive cycle of B(qR) stored at 2,048 sample points. In such an embodiment, the function B(qR) can be rewritten as:

$$B(qR) = \frac{[\sin qR\,(\frac{81\pi}{1024})]\,[\sin qR\,(\frac{16\pi}{1024})]}{\sin \frac{\pi qR}{1024}} \qquad (11)$$

This equation (11) is periodic in (qR) for $(2\times 1024)=2048$ sample points. Moreover, the values of B(qR) for $1024 \leqq (qR) \leqq 2047$ are the complement of the values of B(qR) for $0 \leqq (qR) \leqq 1023$. In other words, the second half of each repetitive cycle of B(qR) has the same absolute values as the first half, but in reverse order and with reverse sign.

These characteristics of equation (11) facilitate a simplified configuration for the memory 46. Thus as illustrated in FIG. 3, the memory 46' advantageously has 1024 storage locations (designated decimal 0 through decimal 1023), each of which stores a value of B(qR) calculated for a value of (qR) corresponding to the storage address. In this manner, half of a repetitive cycle of B(qR) is stored in the memory 46'. The actual stored values can be computed from equation (11) and are typified by FIG. 2.

It will be recalled that the value (qR) is provided on the line 26 in eleven bit binary format. The six most significant bits establish the modulo N. Thus during a single complete cycle of the generated musical waveshape, the value of (qR), in its eleven bit form on line 26, will range from approximately zero through approximately decimal 2047. This is the decimal equivalent of an eleven bit binary number having all binary 1's and neglecting the position of the decimal point.

With this arrangement, as the eleven bit binary value of (qR) on the line 26 varies between decimal 0 and decimal 1023, the memory 46' is accessed at the corresponding address. To this end, the ten least significant bits of (qR) supplied on the line 26 are used directly as the access address location for the memory 46'. The single most significant bit of (qR) in this case is "0." This signal is supplied via the memory address control 47' on a line 54 and used to keep unchanged the sign bit for the value B(qR) supplied from the memory 46' on the line 48'. The same zero-valued most significant bit on the line 54 is inverted by an inverter 55 and used to enable a gate 56 that supplies the ten next significant bits of (qR) via a channel 57 to the address portion of the memory 46'.

For values of (qR) ranging between decimal 1024 and decimal 2047 the most significant bit on the line 54 will be "1." In this case, the gate 56 is disabled and another gate 58 is enabled. The value represented by the ten least significant bits from the line 26 is subtracted from decimal 2047 by a subtractor 59. The remainder, representing the value 2047-(qR), is supplied via the gate 58 and the channel 57 to the address portion of the memory 46'. As a result, the corresponding value B(2047-qR) is read from the memory 46' and supplied via the line 48' to the scaler 49. In this instance, the sign is complemented, as indicated by the "1" bit on the line 54. The output of the scaler 49, representing the value S(qR), is supplied via the line 42 to the adder 43 as described above.

With the configuration of the memory address control 47' just described, the memory 46' (which contains the sampled amplitude values for half a repetitive cycle of B(qR)), is accessed in the "forward" direction as the eleven bit value of (qR) on the line 26 increases from zero through decimal 1023, and is accessed "backwards" as the value (qR) on the line 26 increases from decimal 1024 through decimal 2047. During the forward access of the memory 46', the sign of the accessed value B(qR) is unchanged. During the "backward" read-out, when values in the second half of the repetitive cycle of B(qR) are evaluated, the sign of the value accessed from the memory 46' is complemented by a circuit 60. For example, if the value of B(qR) accessed from the memory 46' was positive, the sign will be changed to negative. Note that in certain logic implementations of the computor organ 10, a negative number may be represented as the complement of the corresponding positive number. In this case, the complement circuit 60 may complement the entire value B(qR) read from the memory 46', rather than altering only the sign bit.

Although in the foregoing description, the extended harmonic summation memory 46 stores values of B(qR) at 1024 sample points for half of the repetitive cycle, the invention is not so limited. Sampled amplitudes at more or fewer sample points may be employed. Further, in the embodiment just described, the value B(qR) was stored in the memory 46 and subsequently scaled by a scale factor in the scaler or multiplication circuit 49. This is not required, and other arrangements could be used. For example, as shown in FIG. 1A the memory 46 **46*a* itself may store scaled values of S(qR), thereby eliminating the need for the scaler 49. Furthermore, the number of bits representing R, representing (qR), or representing the values stored in the adders 25 and 28, in the sinusoid table 29, and in the memory 46** are exemplary only. Other embodiments may use more or fewer bits.

In the embodiment of FIG. 1, the first 32 Fourier components are individually calculated at separate time intervals $t_{cp}$ in a single processing channel. This is not required, and two or more parallel processing channels, such as described in U.S. Pat. No. 3,809,788, may be employed to evaluate these 32 Fourier components. Also, more or fewer than 32 such Fourier components may be evaluated by the computor organ 10, with the higher order components provided by a memory 46 storing values of an algebraic approximation of the Fourier component summation for a selected set of higher order components, which set is not limited to the illustrative range of $33 \leqq n \leqq 48$ described herein.

Intending to claim all novel, useful and unobvious features, shown or described, the inventor claims:

1. In an electronic musical instrument of the type having tone generation means for computing in real time the amplitudes at successive sample points of a musical waveshape, said means including first circuitry for separately evaluating the constituent Fourier components of order less than a certain order M, an accumulator for summing these components, and a converter for converting the obtained amplitudes to musical tones, successive amplitude computations being carried out at regular computation time intervals $t_x$ for successive sample point values, the improvement for extending the harmonic content of the generated musical tones comprising:

a memory storing values of an algebraic approximation of the summation of individual Fourier component amplitudes for an "extended harmonic" set of such components of order greater than W, for different sample point values, memory access control circuitry, connected to receive said sample point values from said first circuitry, for accessing from said memory the value of said approximation for the sample point at which said waveshape amplitude currently is being evaluated, and an adder for adding the accessed approximation value to the summation from said accumulator to obtain said sample point amplitude, said obtained amplitude being provided to said converter.

2. An electronic musical instrument according to claim 1 wherein said memory is accessed once, and only a single accessed approximation value is added by such adder, for each regular computation time interval $t_x$.

3. An electronic musical instrument according to claim 1 wherein said algebraic approximation B(qR) is of the form $$B(qR) = \sum_{n=x}^{y} \sin \frac{2\pi}{N} nqR = \frac{[\sin qR\{\frac{(x+y)\pi}{N}\}][\sin qR\{\frac{(y-x+1)}{N}\}]}{\sin \frac{\pi qR}{N}}$$

where (qR) is said sample point value, q being an integer that is incremented at each computation time interval $t_x$, where n is the Fourier component order, where x and y are the minimum and maximum order values of the Fourier components included in said "extended harmonic" set, with $x>W$ and $y>x$, and where N is a value designating the periodicity of (qR).

4. An electronic musical instrument according to claim 3 wherein a set of said values B(qR) are stored in said memory, and further comprising a scaler for scaling each accessed value, the resultant scaled accessed value being supplied to said adder.

5. An electronic musical instrument according to claim 3 wherein said memory stores algebraic approximation values equal to B(qR) multiplied by a scale factor which establishes the average amplitude contribution of each Fourier component in said "extended harmonic" set.

6. An electronic musical instrument according to claim 3 wherein a plurality of values of B(qR) are stored in said memory for half of a repetitive cycle of B(qR), said memory access control circuitry accessing the stored value of B(qR) when the current sample point value (qR) lies within the half cycle for which values of B(qR) are stored, and wherein when the current sample point value (qR) lies within the other half cycle for which B(qR) is not stored, said memory access control circuitry accesses the stored value corresponding to B(N-qr) and complements the sign of the accessed stored value.

7. An electronic musical instrument according to claim 3 wherein (qR) is represented by an s-bit binary number, wherein said first circuitry uses a byte of less than s most significant bits of said s-bit binary number to establish the periodicity of (qR), and wherein said memory access control circuitry uses a different, larger byte of said s-bit binary number to control accessing of said memory.

8. An electronic musical instrument according to claim 7 wherein said memory has a number of storage locations corresponding to the maximum value of said larger byte, values of said algebraic approximation being stored for a like number of values of B(qR).

9. An electronic musical instrument wherein musical tones having the spectral content of a sawtooth wave are synthesized in real time, comprising:

first means for computing at regular computation time intervals $t_x$ the summation $$\sum_{n=1}^{W} F^{(n)} = \sum_{n=1}^{W} \frac{A}{2\pi n} \sin \frac{2\pi}{N} nqR$$

wherein $n=1,2,3,\ldots W$ designates the order of Fourier components $F^{(n)}$ included in the summation, wherein A is a constant and $A/2\pi n$ is a coefficient establishing the relative amplitude of the corresponding $n^{th}$ component, wherein R is a number specifying the pitch of the generated tone, wherein q is an integer incremented at each time interval $t_x$, and where $N=2W$, second means, including an "extended harmonic summation" memory, for providing at each time interval $t_x$, the value $$S(qR) = \frac{A}{2\pi k} B(qR) = \frac{A}{2\pi k} \frac{[\sin qR\{\frac{(x+y)\pi}{N'}\}][\sin qR\{\frac{(y-x+1)\pi}{N'}\}]}{\sin \frac{\pi qR}{N'}}$$

corresponding to the current value (qR), wherein x and y respectively are minimum and maximum order values of a set of "extended harmonic" Fourier components the amplitude sum of which is represented by the value S(qR), where $W<x<y$, where k is a constant in the range $x \leqq k \leqq y$, and where N' establishes the periodicity of (qR) and B(qR), an adder connected to add the summation $$\sum_{n=1}^{W} F^{(n)}$$

from said first means to the value S(qR) from said second means at each time interval $t_x$, and a converter connected to said adder for converting the sums received from said adder at said time intervals $t_x$ to musical tones.

10. An electronic musical instrument according to claim 9 wherein said memory stores a set of values B(qR) for at least half of a repetitive cycle of B(qR), and wherein said second means further comprises:

a memory access control, responsive to the current value of (qR) utilized by said first means, for accessing the corresponding value B(qR) from said memory, and scaler means for multiplying said accessed value by $A/2\pi k$ to obtain said value S(qR) for supply to said adder.

11. An electronic musical instrument according to claim 10 wherein said memory stores a set of values B(qR) for half a repetitive cycle of B(qR), and wherein for each current value (qR) obtained from said first means said memory access control accesses the corresponding stored value of B(qR) if such is stored, and accesses the complement of the value B(N′−qR) if (qR) is in the range for which no corresponding value of B(qR) is stored.

12. An electronic musical instrument according to claim 11 wherein said memory stores values of S(qR) instead of B(qR).

* * * * *